US005944917A

United States Patent [19]

Takeda et al.

[11] Patent Number: 5,944,917

[45] Date of Patent: Aug. 31, 1999

[54] STAINLESS STEEL FOR OZONE ADDED WATER AND MANUFACTURING METHOD THEREOF

[75] Inventors: Kiyoko Takeda, Amagasaki; Shigeki Azuma, Nishinomiya; Yoshio Tarutani, Sanda; Yoshitaka Nishiyama, Nishinomiya; Yasushi Matsuda, Amagasaki, all of Japan

[73] Assignee: Sumitomo Metal Industries, Ltd., Osaka, Japan

[21] Appl. No.: 08/865,103

[22] Filed: May 29, 1997

[30] Foreign Application Priority Data

May 29, 1996 [JP] Japan ..... 8-135310
Jul. 3, 1996 [JP] Japan ..... 8-173497

[51] Int. Cl.[6] ..... C23C 8/00

[52] U.S. Cl. ..... 148/240; 148/241; 205/320; 420/50; 420/62; 420/79; 420/80; 420/98; 420/103; 420/117; 420/119; 428/472.2

[58] Field of Search ..... 148/240, 241; 428/472.2; 420/50, 52, 56, 57, 62, 63, 67, 79, 80, 96, 97, 98, 103, 117, 119; 205/320

[56] References Cited

U.S. PATENT DOCUMENTS 4,661,169 4/1987 Aggen et al. ..... 148/282

FOREIGN PATENT DOCUMENTS

0571251 A1 11/1993 European Pat. Off. .
4200027 A1 7/1993 Germany .
63-161145 7/1988 Japan .
64-87760 3/1989 Japan .
1-180946 7/1989 Japan .
2-44149 2/1990 Japan .
2-115350 4/1990 Japan .
2-281589 11/1990 Japan .
6-33264 2/1994 Japan .
6-271992 9/1994 Japan .
7-60099 3/1995 Japan .
7-62520 3/1995 Japan .
8-269681 10/1996 Japan .
2160892 1/1986 United Kingdom .
2247249 2/1992 United Kingdom .

OTHER PUBLICATIONS

"Handbook of Stainless Steels", Peckner and Bernstein; McGraw–Hill Book Company, New York; Chapter 16: Corrosion Resistance in Aqueous Media, pp. 16–1 to 16–5, 1977.

*Primary Examiner*—David A. Simmons
*Assistant Examiner*—Robert R. Koehler
*Attorney, Agent, or Firm*—Burns, Doane, Swecker & Mathis, LLP

[57] ABSTRACT

A stainless steel having excellent corrosion resistance to ozone added water, such as ozone added ultrapure water used in semiconductor manufacturing processes and the like, as well as a manufacturing method. The stainless steel comprises a base metal and an oxide film formed on the surface of the base metal, the base metal being a stainless steel which contains 12 to 30% of Cr, 0 to 35% of Ni, and 1 to 6% of Al and Si while the contents of the other alloying elements are limited to as low a level as possible, the oxide film mainly comprising Al oxide or a Si oxide or both. The oxide film may be formed on the base metal surface through the dry oxidation process or the wet oxidation process. In the stainless steel, metallic ions are rarely dissolved from the base metal into the ozone added water. Also, since the contents of alloying elements, other than Cr, Ni, Al, Si, and like necessary elements, are limited to a low level, the stainless steel exhibits excellent corrosion resistance and reduced particle emission.

19 Claims, No Drawings

STAINLESS STEEL FOR OZONE ADDED WATER AND MANUFACTURING METHOD THEREOF

BACKGROUND OF THE INVENTION

1. Field of the Invention

The present invention relates to a stainless steel having excellent corrosion resistance to ozone added water such as ozone added ultrapure water used in semiconductor manufacturing processes and the like, as well as to a manufacturing method thereof.

2. Description of the Related Art

In the field of the manufacturing of semiconductors, the integration of devices has increased in recent years. In the manufacturing of a device called ULSIs, a fine circuit pattern of 1 μm or less is required on substrates such as silicon wafers.

Adhesion of fine dust or impurity gas to such fine circuit patterns causes a circuitry problem. Therefore, in the ULSI manufacturing processes, various measures are taken to prevent such contamination.

For protection of substrates from contamination from the work environment, substrates are processed within a clean room. In order to maintain cleanliness of a clean room, not only air in the clean room must be filtered, but also gases and water used therein must be of high purity. Particularly, ultrapure water whose fine particles and trace impurity is normally used as pure water.

For those reasons, pipes and members used for such gases and water that have high purity is required for the inner surface thereof discharges as contaminants only minimum amount of particles and gases.

Conventionally, ferritic or austenitic stainless steels have been used as materials for pipes and piping members used in semiconductor manufacturing processes. Such stainless steels, when used for high-purity gases, must not emit particles therefrom and must not cause adhesion or adsorption of water. When the stainless steel used for passing ultrapure water therethrough, those stainless steels must be such that metallic ions are less likely to be dissolved.

To meet these requirements, the stainless steels to be in contact with high-purity gases or ultrapure water are usually subjected to a surface-smoothing process to thereby make their surface areas as small as possible. For example, the inner surface of a steel pipe for piping is smoothed, in many cases, so that the maximum height indicative of surface roughness as defined by JIS B0601 (hereinafter referred to as maximum roughness and represented by Rmax) becomes not greater than 1 μm. For this smoothing process, electrochemical polishing is usually conducted on cold-drawn steel pipes and mechanically polished piping members. However, this electrochemical polishing method involves difficulty in controlling an electrolytic solution and conditions of electrolysis and is low in productivity, resulting in increased manufacturing cost of steels.

Also, even when a stainless steel having a smoothed inner surface is used, metallic ions of Fe, Cr, Ni, and other constituent atoms thereof may be dissolved therefrom with pure water such as ultrapure water and the like. In order to prevent this dissolution of metallic ions, various proposals have been made as described below.

A promising measure against the dissolution is to provide an oxide film or the like on the surface of the base metal of a stainless steel.

Japanese Patent Application Laid-open (kokai) No. 1-87760 discloses a stainless steel for use as a material for a semiconductor manufacturing apparatus whose electrochemically polished base metal surface is provided with an amorphous oxide film having a thickness of 75 angstroms or more. Also, Japanese Patent Application Laid-open (kokai) No. 1-180946 discloses a ferritic stainless steel pipe for ultrapure water which has a specific composition and whose inner surface is provided with a passive film having a maximum roughness (Rmax) of 5 μm or less.

Furthermore, some of the present inventors propose in Japanese Patent Application Laid-open (kokai) No. 6-33264 an austenitic stainless steel for a high-purity gas which contains Ti (0.02 to 1.0% by weight) or Al (0.02 to 1.0% by weight) or both and whose base metal surface is smoothed to a maximum roughness (Rmax) of 1 μm or less and provided with an oxide film mainly comprising a Ti oxide or an Al oxide or both.

Also, Japanese Patent Application Laid-open (kokai) No. 7-62520 discloses an austenitic stainless steel for use in a clean room whose base metal containing Si (0.5 to 5.0% by weight) is provided on the surface thereof with an oxide film mainly comprising of Si oxide.

Also, in Japanese Patent Application Laid-open (kokai) No. 7-60099, a steel for use in a super-high vacuum is disclosed wherein the base metal is a stainless steel containing Al (1 to 6% by weight) and a tight Al oxide film having a thickness of 10 to 150 angstroms is provided on the base metal surface thereof. In addition, the inventors of the present invention have proposed an austenitic stainless steel whose base metal has a specific composition and which is provided on the base metal surface thereof with an oxide film mainly comprising of Al oxide, thereby providing excellent oxidation resistance(Japanese Patent Application Laid-open (kokai) No. 6-271992).

Stainless steels employing the above-described measures are practically usable as materials for pipes and apparatus members for handling ultrapure water and high-purity gases as materials for use as well as at high temperatures.

Recently, ozone added water has been used to clean substrates such as silicon wafers in semiconductor manufacturing processes.

In semiconductor manufacturing processes, ultrapure water containing a surfactant, acid, alkali or some of them is normally used to clean silicon wafers and the like. However, a cleaning method using such cleaning water can clean off metallic substances, but does not perform well in cleaning off organic substances, particularly fats and oils which are relatively stable against chemicals. Also, a surfactant, acid, and alkali contained in cleaning water are impurities themselves. Thus, in order to clean off cleaning-water-induced impurities from a silicon wafer surface, "rinsing" must be conducted through use of ultrapure water having higher purity.

In order to omit this "rinsing" step, there has recently been attempted a cleaning method which uses ozone ($O_3$) added ultrapure water to clean silicon wafers. As seen from its use as bleach and disinfectant, ozone has strong oxidation power, and thus ionizes metals and decomposes organic substances. Accordingly, in cleaning with ozone added ultrapure water, adhering metals are removed through ionization, and organic substances are removed through decomposition. Furthermore, after cleaning, ozone decomposes by itself and does not remain on silicon wafers as a contaminant. Thus, cleaning with ozone added ultrapure water can advantageously omit the "rinsing" step.

As described above, ozone added ultrapure water is quite effective for cleaning silicon wafers. However, cleaning with ozone added ultrapure water involves contamination of ozone added ultrapure water with contaminants from pipes and apparatus members in its feed system. Since ozone added ultrapure water corrodes stainless steels used as materials for pipes and apparatus members, metallic ions of Fe, Cr, Ni and the like are dissolved therefrom, they cause contamination for ozone added ultrapure water with such ions.

The aforementioned stainless steels developed for ozone-free ultrapure water and high-purity gases show substantially good performance in prevention of dissolution of metallic ions into ultrapure water as well as particle emission. However, since these stainless steels are not developed with the intention of being used with ozone added water, they are not practically usable with ozone added water due to dissolution of metallic ions of Fe, Cr, Ni and the like therefrom into ozone added water.

Furthermore, the aforementioned stainless steels proposed in Japanese Patent Application Laid-open (kokai) Nos. 1-87760 and 6-33264 require electrochemical polishing in the course of their manufacture, resulting in decreased productivity from electrochemical polishing and increased cost of manufacture.

In view of the foregoing circumstances, there arises the need for developing a stainless steel having excellent corrosion resistance to ozone added water and capable of being manufactured at low cost. These stainless steels are used in fields other than manufacturing semiconductors, for example, in the pharmaceuticals manufacturing fields which involve the handling of ozone added water.

Stainless steels have strength required of materials for pipes and apparatus members handling ultrapure water in semiconductor manufacturing processes and also have excellent workability. However, as described above, under the present conditions, they have a drawback of poor corrosion resistance to ozone added water.

An object of the present invention is to provide a stainless steel having excellent corrosion resistance to ozone added water which does not cause dissolution of metallic ions even when used as a member for ozone added water and which can be manufactured at low cost, as well as to provide a manufacturing method thereof.

SUMMARY OF THE INVENTION

The present invention provides a stainless steel having an excellent corrosion resistance to ozone added water, such as ozone added ultrapure water used in semiconductor manufacturing processes, as well as a manufacturing method.

The stainless steel of the present invention comprises a base metal having the following chemical composition based on % by weight and an oxide film formed on the surface of the base metal, the oxide film mainly comprised of an Al oxide or a Si oxide or both.

| | |
|---|---|
| Cr: 12 to 30%, | Ni: 0 to 35%, |
| Al + Si: 1 to 6%, | Mo: 0 to 3%, |
| B + La + Ce: 0 to 0.01%, | Cu: max 0.1%, |
| Nb + Ti + Zr: 0.1% max, | C: max 0.03%, |
| Mn: max 0.2%, | P: max 0.03%, |
| S: max 0.01%, | N: max 0.05%, |
| O: max 0.01% and | |
| balance: Fe and incidental impurities. | |

That is, the stainless steel of the present invention comprises a stainless steel as a base metal which contains 1 to 6% by weight in total content of Al and Si while the amounts of other alloying elements which are respectively limited to a low level. Furthermore, the oxide film is formed on the base metal surface, hence, the oxide film is formed with Al and Si contained in the base metal and mainly comprised of an Al oxide or a Si oxide or both.

The stainless steel of the present invention provides sufficient performance and properties as described in the above-described conditions. Preferably, a maximum surface roughness as defined in JIS B0601 (hereinafter referred to as the maximum roughness and represented by Rmax) is less than 3 $\mu$m, and the oxide film has a thickness of 5 nm to 500 nm and mainly comprises an Al oxide, particularly $\alpha Al_2O_3$.

In manufacturing the stainless steel of the present invention, the oxide film may be formed on the base metal surface by any of the following methods (a) to (c):

(a) The base metal is heated to a temperature of 600 to 1200° C. in weak oxidizing atmosphere at a combined partial pressure of oxygen gas and water vapor of $10^{-11}$ to $10^{-5}$ MPa.

(b) The base metal is dipped in an solution of nitric acid, ranging in concentration from 5 to 50% by weight.

(c) The base metal is subjected to anodic electrolysis in a solution having a pH value of not greater than 1.

The stainless steel of the present invention or the stainless steel obtained by the manufacturing method of the invention comprises a film which, in turn, comprises an Al oxide or a Si oxide or both having an excellent preventive effect against dissolution of metallic ions from the base metal into ozone added water. The oxide film of the invention is particularly effective in corrosion resistance to ozone added water, because constituent oxides are stable against a relatively high oxidation-reduction potential particularly for ozone added water. Furthermore, since the amounts of alloying elements other than the necessary Cr, Ni, Al, Si, etc. are respectively limited to low levels, oxides other than an Al oxide and a Si oxide, i.e. oxides which reduce an effect of preventing dissolution of metallic ions, are less likely to be formed.

In addition, except for dissolution of metallic ions, the stainless steel of the present invention is characterized by having small amounts of elements such as S, C, Mn, N, P, etc. which cause an initiation site of corrosion and emission of particles. Accordingly, the stainless steel of the invention provides reduced particle emission as well as an excellent corrosion resistance.

DETAILED DESCRIPTION

The inventors of the present invention, have manufactured steels whose base metals are stainless steels having various chemical compositions and wherein an oxide film is formed on the surface of the base metals. These steels were studied for the behavior of dissolution of metallic ions in ozone added ultrapure water. In addition, oxide films having different chemical compositions were formed through oxidation of the base metals under different oxidation conditions.

As a result, the following findings 1) to 6) were obtained.

1) An oxide film that is effective for prevention of dissolution of metallic ions comprised of an Al oxide or a Si oxide or both, which are formed through preferential oxidation of Al or Si or both as contained in the base metal. This oxide film is chemically stable against ozone added water and is substantially unreactive. Also, the oxide film provides a remarkable effect of preventing alloying elements from dissolving from the base metal into ozone added water. Thus, metallic ions are less likely to be dissolved from a steel in contact with the ozone added water.

2) In order to suppress dissolution of the metallic ions and emission of particles from steels, the amounts of minor constituent elements of the steel, such as C, Si, Mn, P, S, Cu, N, and O (hereinafter referred to as impurity elements) must be respectively limited to a low level. Through an appropriate combination of the above-described oxide film and contents of impurity elements, dissolution of the metallic ions from a steel into the ozone added water and particle emission from a steel can effectively be prevented.
3) The above-described findings 1) and 2) are observed with both ferritic and austenitic stainless steels.
4) The oxide film described above in 1) can be easily formed by heating a base metal in an oxidizing atmosphere under predetermined conditions. Also, the oxide film can be formed by dipping a base metal in a nitric acid solution or subjecting a base metal to anodic electrolysis.

Based on the above-described findings, the inventors achieved the invention. The invention will now be described in detail.

(1) Oxide film on steel surface

The stainless steel of the present invention is characterized in that an oxide film is formed on the surface of a base metal, the oxide film mainly comprised of an Al oxide or a Si oxide or both(hereinafter simply referred to as an (Al, Si) oxide) formed through oxidation of Al or Si or both contained in the base metal.

Preferably, this oxide film mainly comprises of an Al oxide and a Si oxide. The larger the proportion of an Al oxide and a Si oxide as part of all oxides, the better the corrosion resistance to ozone added water. Accordingly, the proportion of the total amount of Al and Si as (Al,Si) oxide to the total amount of all metallic elements contained in the oxide film is preferably not less than 60 atomic %, more preferably 80 atomic %. Oxides other than an Al oxide and a Si oxide include a Cr oxide and a Fe oxide, and are desirable to be contained in lesser amounts in the oxide film as described above.

An Al oxide and a Si oxide have an excellent effect of improving corrosion resistance of a stainless steel to ozone added water. As compared with a Si oxide, an Al oxide is more effective for improvement of corrosion resistance to. ozone added water. Therefore, more preferably, the oxide film mainly comprises an Al oxide without containing a Si oxide. Al oxides, i.e. aluminas ($Al_2O_3$), are divided into $\alpha$, $\theta$, $\gamma$, and $\delta$ types. Among these types of aluminas, the $\alpha$ type alumina ($\alpha Al_2O_3$) is most preferred.

The surface roughness of the stainless steel of the present invention, i.e. the surface roughness of the oxide film, is preferably less than 3 $\mu$m in terms of maximum roughness (Rmax). When Rmax is 3 $\mu$m or greater, foreign substances such as airborne salt particles and dust are likely to adhere to the surface of the stainless steel in manufacturing process and during the period from manufacturing a product to use of the product. Adhesion of such foreign substances to the surface of a steel may cause particle emission and may decrease corrosion resistance of the steel to ozone added water.

The thickness of the oxide film is preferably 5 to 500 nm. When the oxide film thickness is less than 5 nm, sufficient corrosion resistance to ozone added water cannot be obtained. When the oxide film thickness is in excess of 500 nm, the oxide film quality decreases with the thickness, resulting in a failure to obtain sufficient corrosion resistance to ozone added water. The oxide film thickness is more preferably 10 to 300 nm.

(2) Composition of the base metal

The base metal of the stainless steel of the present invention has the following chemical composition. The content of each element is represented in % by weight (hereinafter simply referred to as %).

Cr: Cr is an essential element for the base metal. Cr ensures the corrosion resistance expected in environmental usage of stainless steel. Furthermore, the presence of Cr can prevent rusting corrosion in a neutral aqueous solution such as pure water and in a clean room atmosphere. To obtain the above effects of Cr, at least 12% of Cr must be contained.

On the other hand, when the Cr content is in excess of 30%, the hot workability of the base metal decreases. Also, when such a stainless steel is welded, intermetallic compounds containing Cr, such as the sigma phase, are likely to precipitate in a welded zone, resulting in decreased toughness. Accordingly, the Cr content is 12 to 30%, preferably 18 to 25%.

When the base metal is an austenitic stainless steel containing 14 to 35% of Ni, the upper limit of Cr is preferably 25% in view of the hot workability and toughness of a welded zone.

Ni: Ni improves corrosion resistance of the base metal and is effective in obtaining a stable austenitic structure. In the stainless steel of the present invention, Ni is added when it is needed.

The base metal may be ferritic, duplex, or austenitic. However, a simplex stainless steel, i.e. a ferritic or austenitic stainless steel, features an easier formation of a uniform oxide film, as compared with a duplex stainless steel.

When the base metal is ferritic, the Ni content is preferably 0 to 5%. When the Ni content is in excess of 5%, the base metal becomes duplex. Therefore, in the process of forming the oxide film, processing conditions must be more accurately controlled.

When the base metal is austenitic, the Ni content is preferably not less than 14% in order to obtain a stable austenitic structure. Nevertheless, when the Ni content is in excess of 35%, an intermetallic compound consisting of Ni and Al precipitates, resulting in a decrease of hot workability and toughness of the base metal. Therefore, the Ni content may be from 14 to 35%. For the austenitic base metal, the preferred Ni content is 18 to 25%.

Al and Si: Al and Si are most characteristic and important alloying elements for the stainless steel of the present invention. That is, the stainless steel of the present invention is characterized by the (Al, Si) oxide film formed through oxidation of Al or Si or both contained in the base metal.

As already mentioned, in this oxide film, the ratio of the total amount of Al and Si to the total amount of all metallic elements contained therein is preferably at least 60 atomic %. When the combined content of Al and Si in the base metal is less than 1%, the (Al, Si) oxides account for too small a proportion of oxides contained in the oxide film, the above-mentioned requirements are not fulfilled. As a result, the stainless steel fails to have sufficient corrosion resistance to ozone added water.

On the other hand, when the combined content of Al and Si is in excess of 6%, toughness of the base metal tends to decrease. Also, for the austenitic base metal, intermetallic compounds consisting of Ni and Al precipitate, resulting in decrease of the hot workability and toughness of the base metal.

Therefore, the combined content of Si and Al is determined to be from 1 to 6%. In order to improve corrosion resistance to ozone added water and ensure good hot workability and toughness, the combined content of Al and Si is preferably 1 to 4%, more preferably 2 to 4%.

Since an Al oxide film is superior to a Si oxide film in corrosion resistance to ozone added water, an Al oxide film is preferred. When an oxide film does not contain a Si oxide, the Si content of the base metal is preferably not greater than 0.2%.

Mo: Mo is added as needed. Since Mo has the effect of improving corrosion resistance to ozone added water, hence, Mo is added to further improve corrosion resistance to ozone added water. To obtain this effect of Mo, the Mo content is preferably not less than 0.3%. However, when the Mo content is in excess of 3%, intermetallic compounds consisting of Mo and Si are likely to precipitate, resulting in a decreased toughness of the base metal. Therefore, the Mo content is in the range of 0 to 3%. When Mo is added, its content is preferably between 0.01 and 3%.

B, La, and Ce: B, La, and Ce are added as needed. These elements improve toughness and hot workability of the base metal. In some cases in which Al, Si, and Ni contents of the stainless steel of the present invention are rather high, hot-working of the material may become easier when toughness and hot workability are further elevated. In such cases, it is recommended that at least one element of B, La, or Ce be added. When these elements are added, segregation of P and S to grain boundaries and coarsening of grains are inhibited, thereby improving the toughness and hot-workability.

In order to obtain effects of these elements, it is preferred that 0.003% or more in total of B, La, and Ce be contained. However, since the presence of B in an excessive amount causes Cr carbide to precipitate in increased amounts, the material becomes more sensitive to thereby decrease corrosion resistance of the base metal. Also, when excessive amounts of La and Ce are present, amounts of oxides of these elements increase, to thereby decrease the hot-workability. Therefore, the upper limit of the total amount of B, La, and Co is preferably 0.01%.

Thus, because of the above-mentioned reasons, the total amount of B, La, and Ce is determined to be from 0 to 0.01%. When these elements are added, they are preferably between 0.003% and 0.01%, more preferably between 0.003 and 0.008%, in total.

Cu: Since the presence of Cu may cause dissolution of Cu ions into ozone added water, the Cu content is desirably limited to a low level. Therefore, the Cu content is preferably not greater than 0.1%.

Nb, Ti and Zr: Nb, Ti, and Zr are likely to be oxidized. Accordingly, the presence of these elements in the steel causes the formation of their oxides, resulting in entry of these oxides into the oxide film of the steel. In other words, the proportion of Al and Si to all metallic elements contained in the oxide film decreases below 60 atomic %. In this case, the corrosion resistance of the steel to ozone added water decreases. Particularly, when the combined content of Nb, Ti, and Zr is in excess of 0.1%, corrosion resistance to the ozone added water significantly decreases.

Therefore, the combined content of Nb, Ti, and Zr is determined to be not greater than 0.1% and is preferably not greater than 0.05%.

C: When the C content is too high, a Cr carbide is likely to be formed in a welded zone when such a stainless steel is welded, resulting in a decreased Cr content in the vicinity of grain boundaries. This causes a significant decrease of rusting resistance and intergranular corrosion resistance. Also, during heating for forming the oxide film, a carbide may be formed, resulting in a significant decrease of rusting resistance and intergranular corrosion resistance. Since a lower C content is desirable, the C content is determined to be not greater than 0.03% and is preferably not greater than 0.02%.

Mn: Mn prevents forming an (Al, Si) oxide film and thus decreases the corrosion resistance of the steel to ozone added water. Also, when such a steel is welded, Mn preferentially concentrates at the surface of a welded zone, resulting in significant decrease of the rusting corrosion resistance and the pitting corrosion resistance of the steel. Thus, a lower Mn content is desirable. However, since Mn functions to effect an improvement in hot workability of the stainless steel, a small amount of Mn may be added, when the effect is needed.

In view of the above-described circumstances, the Mn content of the stainless steel of the present invention is determined to be not greater than 0.2% and is preferably not greater than 0.05%.

P: Since P decreases weldability of the steel, a lower P content is desirable. Particularly, the P content in excess of 0.03% causes a significant decrease of weldability. Therefore, the P content is determined to be not greater than 0.03% and is preferably not greater than 0.02%.

S: S forms sulfides, which, in turns, results in nonmetallic inclusions in the steel. The nonmetallic inclusions of sulfides in the oxide film causes a defect, resulting in decrease of corrosion resistance to the ozone added water. This nonmetallic inclusion is also a cause of decrease of smoothness of the base metal surface and becomes an initiation site of corrosion. Furthermore, this nonmetallic inclusion becomes a particle (dust) when the steel is used as a material for piping in a semiconductor manufacturing equipment, thus contaminates substrates such as silicon wafers. Therefore, since the S content is desired to be lower, it is determined to be not greater than 0.01%. The S content is preferably not greater than 0.005%, more preferably not greater than 0.002%.

N: N forms an Al nitride through reacting with Al contained in the steel and is also likely to form carbo-nitrides through reacting with Cr, Ti, Nb, etc. together with C. Like sulfide-based nonmetallic inclusions, these nonmetallic inclusions cause particle emission. Also, the formation of these nonmetallic inclusions decreases the amount of Al required to form an Al oxide film, resulting in decreased corrosion resistance to ozone added water. Therefore, since the N content is desired to be lower, it is determined to be not greater than 0.05%. The N content is preferably not greater than 0.03%.

O (oxygen): O usually exists in the steel in the form of oxide-based nonmetallic inclusions. Like the aforementioned sulfide-based nonmetallic inclusions, oxide-based nonmetallic inclusions cause defects in the oxide film, resulting in decreased corrosion resistance to ozone added water. Oxide-based nonmetallic inclusions cause particle emission from the steel when the steel is used as a material for piping or the like. Therefore, since the O content is desired to be lower, it is determined to be not greater than 0.01%. The O content is preferably not greater than 0.002%.

(3) Polishing the base metal

To prevent adhesion of foreign substances to the surface of the steel, the steel surface is preferably as smooth as possible. Since the oxide film is as thin as 500 nm or less as already mentioned, the base metal surface may be smoothed before the oxide film is formed thereon, to thereby smooth the surface of the steel.

Thus, the base metal surface may be polished before the oxide film is formed. In this case, since the surface of the steel having the oxide film is preferably a maximum roughness (Rmax) of less than 3 $\mu$m as already mentioned, the base metal surface is preferably processed to a maximum roughness (Rmax) of less than 3 $\mu$m.

Since the base metal may be polished such that the maximum roughness (Rmax) of the polished base metal surface is substantially less than 3 μm, it is not necessary to employ the electrochemical polishing method, which provides a polishing accuracy of not greater than 1 μm in Rmax. The base metal of the present invention may be polished through mechanical polishing, such as honing or lapping, or buffing.

(4) Methods of forming the oxide film

The stainless steel of the present invention is provided with an (Al, Si) oxide film which is formed through oxidation of Al and Si contained therein in preference to other oxidizable alloying elements. The manufacturing method of the present invention employs a dry oxidation process or a wet oxidation process for preferentially oxidizing Al and Si contained in the base metal while oxidation of other alloying elements contained in the base metal are suppressed. These two oxidation processes will be described below.

Dry oxidation process:

The dry oxidation process for preferentially oxidizing Al and Si contained in the base metal may be conducted through the application of heat at a temperature of 600 to 1200° C. in a weak oxidizing atmosphere such as an inert gas atmosphere, a hydrogen atmosphere, or a vacuum atmosphere, each containing oxygen and water vapor at a combined partial pressure of $10^{-11}$ to $10^{-5}$ MPa. When either oxygen or water vapor is contained, its partial pressure may also be $10^{-11}$ to $10^{-5}$ MPa.

Below is described the reason for employing a weak oxidizing atmosphere such as an inert gas, hydrogen, or vacuum atmosphere containing oxygen and water vapor at a combined partial pressure of $10^{-11}$ to $10^{-5}$ MPa in order to conduct dry oxidation.

When the combined partial pressure of oxygen and water vapor is less than $10^{-11}$ MPa, Al and Si are not sufficiently oxidized, thus failing to form an oxide film capable of establishing sufficient corrosion resistance to ozone added water. On the other hand, when the combined partial pressure of oxygen and water vapor is greater than $10^{-5}$ MPa, elements other than Al and Si, such as Cr, Fe, etc., are more likely to be oxidized. As a result, the proportions of a Cr oxide, a Fe oxide, etc. contained in the oxide film increase, resulting in decreased corrosion resistance to ozone added water. Also, the smoothness of the oxide film surface tends to decrease, resulting in a failure to obtain a maximum roughness (Rmax) of 3 μm. The combined partial pressure of oxygen and water vapor preferably ranges from $10^{-8}$ to $10^{-5}$ MPa.

When a heating temperature is lower than 600° C., Al and Si are not sufficiently oxidized. On the other hand, when the heating temperature is higher than 1200° C., elements other than Al and Si, such as Cr, Fe, etc., are also oxidized, resulting in increased proportions of a Cr oxide, a Fe oxide, etc. contained in the oxide film. Furthermore, the smoothness of the oxide film surface decreases. Accordingly, when the heating temperature is either lower than 600° C. or higher than 1200° C., the steel fails to be provided with such an oxide film that gives the steel good corrosion resistance to ozone added water. The heating temperature preferably ranges from 850 to 1100° C.

A heating time preferably ranges from 5 minutes to 2 hours. When the heating time is shorter than 5 minutes, the oxide film is not sufficiently formed even under the above-described heating conditions. On the other hand, when the heating time is longer than 2 hours, productivity decreases. The heating time more preferably ranges from 5 minutes to 1 hour.

The above-described dry oxidation conditions are applicable to all stainless steel having the composition defined by the present invention.

Wet oxidation process:

The wet oxidation process is divided into dipping and anodic electrolysis.

A nitric acid solution is appropriately used for dipping. In this case, the concentration of nitric acid in the solution is preferably 5 to 50% by weight. This concentration range enables preferential oxidation of Al and Si contained in the base metal.

When the concentration of nitric acid in the nitric acid solution is less than 5% by weight, elements other than Al and Si, such as Cr, Fe, etc., are also likely to be oxidized. As a result, the proportions of oxides of other than Al and Si contained in the oxide film increase. On the other hand, when the concentration of nitric acid is in excess of 50% by weight, the steel is corroded by nitric acid. As a result, the smoothness of the steel surface decreases, and consequently the Rmax value may become 3 μm or greater.

Preferably, the temperature of the nitric acid solution ranges from 20 to 90° C., and the dipping time ranges from 10 minutes to 5 hours. When the temperature of the nitric acid solution is lower than 20° C., the oxide film is formed at a relatively low rate, resulting in a longer oxidation time. On the other hand, when the solution temperature is in excess of 90° C., the nitric acid vapor intensively evaporates from the nitric acid solution, resulting in decrease in the nitric acid concentration of the nitric acid solution. Furthermore, the working environment becomes significantly bad. The temperature of the nitric acid solution preferably ranges from 40 to 70° C.

When the time of dipping in the nitric acid solution is less than 10 minutes, the oxide film is not sufficiently formed. On the other hand, when the time of dipping in the nitric acid solution is in excess of 5 hours, productivity decreases. The time of dipping in the nitric acid solution more preferably ranges from 30 minutes to 3 hours.

Anodic electrolysis is preferably conducted in an acid solution having pH not greater than 1, for example, an aqueous solution of sulfuric acid having a concentration of 10% by weight.

When the pH value of an electrolytic solution used for anodic electrolysis is in excess of 1, elements other than Al and Si, such as Cr, Fe, etc., are also likely to be oxidized. As a result, the proportions of a Cr oxide, a Fe oxide, etc. contained in the oxide film increase.

In anodic electrolysis, a potential is preferably controlled so as to maintain a constant rate against the varying surface area of an electrode. This potential control can be performed through control of a potential to a saturated calomel electrode (SCE) serving as a reference electrode. In this case, preferably, the potential ranges from 0.2 to 1.5 V (vs SCE), the temperature of the electrolytic solution ranges from 20 to 90° C., and the processing time ranges from 10 minutes to 5 hours.

Even though the pH value of the electrolytic solution is not greater than 1 as described above, when the potential to SCE is less than 0.2 V, a sufficient oxide film may not be obtained, since the decomposition rate of Si and Al contained in the base metal is relatively small. On the other hand, when the potential to SCE is in excess of 1.5 V, the oxide film becomes porous. Also, the proportions of an Al oxide and a Si oxide contained in the oxide film decrease. The potential to SCE more preferably ranges from 0.4 to 1.0 V.

The temperature of the electrolytic solution preferably ranges from 20 to 90° C. When the temperature is lower than 20° C., the oxide film is not sufficiently formed. On the other hand, when the temperature is in excess of 90° C., the vapor of a solvent such as sulfuric acid or the like intensively evaporates from the electrolytic solution, resulting in decrease in the pH of the electrolytic solution. Furthermore, the working environment becomes significantly bad. The temperature of the electrolytic solution preferably ranges from 40 to 70° C.

The time of anodic electrolysis preferably ranges from 10 minutes to 5 hours. When the time of anodic electrolysis is less than 10 minutes, the oxide film is not sufficiently formed. On the other hand, when the time of anodic electrolysis is in excess of 5 hours, productivity decreases. The time of anodic electrolysis more preferably ranges from 30 minutes to 3 hours.

EMBODIMENTS

Stainless steels whose base metals are ferritic stainless steels and austenitic stainless steels were examined.

EXAMPLE 1

Stainless steels (a) to (l) having compositions as shown in Table 1 were melted (50 kg each) through use of a vacuum melting furnace to thereby obtain steel ingots for use as base metals. The steels (a) to (h) represent an invention example, in which the steels (a) to (g) are ferritic, and the steel (h) is duplex. The steels (i) to (l) represent a comparative example, in which the content of a certain constituent element falls outside a relevant content range specified by the present. invention and in which the steels (i) to (k) are ferritic, and the steel (l) corresponds to austenitic SUS316L specified in JIS G4303.

TABLE 1

| Steel | C | Si | Mn | P | S | Cu | Ni | Cr | Mo | Al | N | O | Al + Si | Nb + Ti + Zr |
|---|---|---|---|---|---|---|---|---|---|---|---|---|---|---|
| | Chemical Composition (Weight %) | | | | | | | | | | | | Balance: Fe and Incidental Impurities | |
| Examples of the Invention | | | | | | | | | | | | | | |
| a | 0.011 | 1.82 | 0.03 | 0.018 | 0.001 | 0.02 | 0.22 | 20.55 | — | 0.012 | 0.002 | 0.003 | 1.83 | — |
| b | 0.006 | 3.56 | 0.15 | 0.013 | 0.002 | 0.01 | 0.03 | 19.2 | 0.12 | 0.035 | 0.002 | 0.009 | 3.60 | — |
| c | 0.008 | 2.86 | 0.02 | 0.011 | 0.001 | — | 0.04 | 21.6 | — | 0.060 | 0.003 | 0.002 | 2.92 | 0.04 |
| d | 0.008 | 0.24 | 0.02 | 0.008 | 0.006 | — | 2.04 | 18.6 | 0.85 | 1.39 | 0.004 | 0.008 | 1.63 | — |
| e | 0.004 | 0.36 | 0.04 | 0.018 | 0.003 | — | — | 22.3 | — | 4.63 | 0.003 | 0.005 | 4.99 | — |
| f | 0.006 | 0.13 | 0.16 | 0.011 | 0.002 | 0.02 | — | 20.6 | — | 5.11 | 0.002 | 0.007 | 5.24 | 0.05 |
| g | 0.006 | 1.32 | 0.08 | 0.009 | 0.002 | — | — | 21.6 | — | 2.13 | 0.002 | 0.008 | 3.35 | 0.07 |
| h | 0.008 | 0.47 | 0.04 | 0.009 | 0.002 | — | 6.03 | 18.8 | — | 3.62 | 0.002 | 0.008 | 4.09 | — |
| Examples of the Comparison | | | | | | | | | | | | | | |
| i | 0.005 | 0.85 | 0.06 | 0.013 | 0.001 | — | 0.12 | 19.2 | — | 0.12 | 0.003 | 0.006 | 0.97* | — |
| j | 0.006 | 0.16 | 0.02 | 0.013 | 0.002 | — | — | 20.6 | — | 0.76 | 0.006 | 0.008 | 0.92* | — |
| k | 0.008 | 2.84 | 0.03 | 0.011 | 0.002 | — | — | 18.5 | — | 5.54 | 0.004 | 0.006 | 8.38* | |
| l | 0.010 | 0.52 | 0.06 | 0.011 | 0.002 | — | 14.6 | 17.8 | 2.01 | 0.012 | 0.006 | 0.007 | 0.53* | — |

*marks show that they are outside the range specified by the invention.

Next, these steel ingots were hot forged and hot rolled, followed by cold rolling to obtain steel plates having a thickness of 2 mm. The thus-obtained plates of the base metals were subjected to a solution treatment; specifically, they were held at a temperature of 960° C. for 10 minutes and were then cooled with water.

Samples measuring 50 mm (width)×50 mm (length)×1 mm (thickness) were obtained from these plates through machining. The samples were then buffed over the entire surfaces thereof so as to finish their surfaces to mirror surfaces (0.3 to 0.5 μm in Rmax). Furthermore, the samples were oxidized through dry oxidation process or wet oxidation process to thereby form an oxide film on the surface of each plate. Table 2 shows atmospheric conditions of the dry oxidation process. The heating time for the dry oxidation process was 2 hours for all atmospheric variations of Table 2. Table 3 shows processing conditions of the wet oxidation process. The wet oxidation process was conducted by two methods, i.e. dipping in an acid solution and anodic electrolysis. In the case of oxidation through anodic electrolysis, a potential was controlled so as to maintain solution at a constant rate against the varying surface area of an electrode. That is, a potential to a saturated calomel electrode serving as a reference electrode was controlled during anodic electrolysis. In the case of the wet oxidation process, processed samples were cleaned with ultrapure water and were then dried through use of argon gas having a purity of 99.999% by volume.

TABLE 2

| | | Conditions for High Temperature Oxidation | |
|---|---|---|---|
| | | Atmosphere Gas | Combined Partial Pressure of Oxygen and Water Vapor (MPa) |
| Examples of the Invention | A | Hydrogen | $10^{-7.8}$ |
| | B | Argon | $10^{-9.4}$ |
| | C | Vaccum | $10^{-7.4}$ |
| Examples of the Comparison | D | Hydrogen | $10^{-4.5}$ |
| | E | Hydrogen | $10^{-11.4}$ |

TABLE 3

| | | Solution | Conditions of Treatment | References |
|---|---|---|---|---|
| Examples of the Invention | G | Nitric Acid (30%) | 70° C. | Dipping |
| | H | Nitric Acid (40%) | 70° C. | Dipping |
| | I | Sulfic Acid (5%), pH: 0.1 | 70° C., 0.5 V vs SCE | Anodic Electrolysis |

TABLE 3-continued

| | | Solution | Conditions of Treatment | References |
|---|---|---|---|---|
| Examples of the Comparison | J | *Nitric Acid (3%) | 70° C. | Dipping |
| | K | *Sulfic Acid (0.3%), pH: 1.2 | 70° C., 0.5 V vs SCE | Anodic Electrolysis |

(1) The concentration of solutions is presented in % by weight.
(2) The time for every treatment is 2 hours.

The oxidized samples were examined for an oxide contained in the oxide film, the combined proportion of Al and Si to all metallic elements contained in the oxide film, the thickness of the oxide film, and corrosion resistance to ozone added water.

An oxide contained in the oxide film was identified through Raman laser spectroscopy. Specifically, the crystal structures of compounds contained in the oxide film were examined to thereby determine the presence of $Al_2O_3$, $SiO_2$, etc.

The combined proportion of Al and Si to all metallic elements contained the oxide film and the oxide film thickness were examined through secondary ion mass spectroscopy. Specifically, elemental analysis was conducted at each measurement point along the direction of depth from the oxide film surface. Nitrogen gas ions were used for sputtering.

Corrosion resistance to ozone added water was examined in the following manner. First, being dipped in 50 ml of ultrapure water having a resistivity of 16 MΩcm, samples were held in an oxygen atmosphere containing 110 g/m$^3$ of ozone at a temperature of 80° C. for 100 hours. In this case, the ultrapure water becomes ozone added water containing approximately 7 mg/l of ozone. Next, this ozone added water was quantitatively analyzed through induce-coupled plasma ion mass spectroscopy, obtaining the amount of metallic ions dissolved thereinto (the combined amount of Fe ions, Cr ions, Ni ions, Si ions, and Al ions). The amount of dissolution of metallic ions per apparent surface area of a sample including end surfaces was obtained from the results of the analysis, thereby evaluating corrosion resistance to ozone added water. Criteria for evaluation of the amount of dissolution are as follows: good: less than 0.5 mg/m$^2$; fair: 0.5 mg/m$^2$ to less than 2.0 mg/m$^2$; defective: 2.0 mg/m$^2$ or more. Table 2 shows the results of the evaluation, wherein ○, Δ, and X represent "good," "fair," and "defective," respectively.

Table 4 shows oxidation conditions and the results of the examination of properties of oxide films and corrosion resistance to ozone added water. Oxidation conditions A to K in Table 4 correspond to atmospheric conditions A to F of the dry oxidation process in Table 2 and processing conditions G to K of the wet oxidation process in Table 3.

TABLE 4

| | Base Metal | | Oxidation | | Oxide Film | | | Corrosion |
|---|---|---|---|---|---|---|---|---|
| Test No. | Steel | Content of (Al + Si) (Wt %) | Condition (Table 2, 3) | Temperature (°C.) | Kind of Oxide | Content of (Al + Si) (Atomic %) | Thickness of Oxide Film (nm) | Resistance to Ozone Added Water |
| Examples of the Invention | | | | | | | | |
| 1 | a | 1.83 | A | 880 | $SiO_2$ | 62 | 17 | ○ |
| 2 | b | 3.60 | A | 880 | $SiO_2$ | 63 | 41 | ○ |
| 3 | c | 2.92 | A | 880 | $SiO_2$ | 84 | 26 | ○ |
| 4 | d | 1.63 | A | 880 | $Al_2O_3$ | 63 | 16 | ○ |
| 5 | e | 4.99 | A | 880 | $Al_2O_3$ | 74 | 23 | ○ |
| 6 | f | 5.24 | A | 880 | $Al_2O_3$ | 92 | 27 | ○ |
| 7 | g | 3.35 | C | 880 | $Al_2O_3$, $SiO_2$ | 83 | 22 | ○ |
| 8 | h | 4.09 | A | 880 | $Al_2O_3$ | 72 | 21 | ○ |
| 9 | f | 5.24 | A | 650 | $Al_2O_3$ | 62 | 14 | ○ |
| 10 | f | 5.24 | A | 980 | $Al_2O_3$ | 65 | 39 | ○ |
| 11 | f | 5.24 | A | 1080 | $Al_2O_3$ | 60 | 43 | ○ |
| 12 | f | 5.24 | B | 880 | $Al_2O_3$ | 72 | 26 | ○ |
| 13 | f | 5.24 | C | 880 | $Al_2O_3$ | 90 | 28 | ○ |
| 14 | f | 5.24 | G | 70 | $Al_2O_3$ | 69 | 21 | ○ |
| 15 | f | 5.24 | I | 70 | $Al_2O_3$ | 75 | 27 | ○ |
| Examples of the Comparison | | | | | | | | |
| 16 | i | 0.97* | A | 880 | $SiO_2$ | 35 | 10 | Δ |
| 17 | j | 0.92* | A | 880 | $Al_2O_3$ | 42 | 14 | Δ |
| 18 | k | 8.38* | — | — | — | — | — | — |
| 19 | l | 0.53* | A | 880 | $SiO_3$ | 11 | 11 | x |
| 20 | f | 5.24 | A | 580* | $Al_2O_3$ | 39 | 3 | Δ |
| 21 | f | 5.24 | A | 1220* | $Al_2O_3$ | 15 | 40 | x |
| 22 | f | 5.24 | D* | 880 | $Al_2O_3$ | 21 | 28 | x |
| 23 | f | 5.24 | K* | 70 | $Al_2O_3$ | 26 | 14 | x |
| 24 | f | 5.24 | J* | 70 | $Al_2O_3$ | 38 | 17 | Δ |

*mark show that they are outside the range specified by the invention.

The results of test Nos. 1 to 3 for the invention example exhibit a Si content not less than 1% in the steels, and the results of test Nos. 4 to 7 for the invention example exhibit an Al content of not less than 1% in the steels, indicating that the combined content of Si and Al falls within the range from 1% to 6% specified by the present invention. Furthermore, the oxidation conditions for the oxide films satisfy the conditions specified by the manufacturing method of the present invention. As in the results, each of the oxide films comprises $SiO_2$ or $Al_2O_3$ or both, and the combined proportion of them to all metallic elements contained in the oxide film was as high as 62 to 92 atomic %. Also, the test results of the invention example exhibited excellent corrosion resistance to ozone added water. For the invention example, the oxide film thickness (over an area where the combined proportion of Si and Al to all metallic elements contained in the oxide film is not less than 60 atomic %) fell within the range from 16 to 43 nm.

In test No. 6 and test Nos. 8 to 10, the temperature of oxidation was varied over the range from 650° C. to 1080° C. In test Nos. 11 and 12, the atmosphere of oxidation was an argon or vacuum atmosphere wherein oxygen and water vapor were present. All of these tests exhibited good results regarding the properties of oxide films and corrosion resistance to ozone added water as in the tests described above.

The steel used in test No. 13 contains Ni in an amount of 6.03%, slightly higher than that of a ferritic steel. In test Nos. 14 and 15, an oxide film was formed through the wet oxidation process. All of these tests exhibited good results regarding the properties of oxide films and corrosion resistance to ozone added water.

In contrast to the invention example described above, the results of test Nos. 16 to 24 except No. 18 of the comparative example exhibited poor corrosion resistance to ozone added water. The reason for this is as follows: in test Nos. 16, 17, and 19, the Si and Al contents of the steels were too low; in test Nos. 20 to 24, the conditions of forming an oxide film failed to meet the conditions specified by the present invention. In test No. 18, the combined content of Si and Al of the base metal was too high. In this case, the base metal cracked during hot working due to its poor hot workability, and thus the test failed and was not completed.

EXAMPLE 2

Austenitic stainless steels (a) to (m) having the compositions of Table 5 were melted, 50 kg each, through use of a vacuum melting furnace to thereby obtain steel ingots for use as base metals. The steels (a) to (h) represent an invention example, in which the steels are all austenitic. The steels (i) to (m) represent a comparative example, in which the content of a certain constituent element falls outside a relevant content range specified by the present invention and in which the steels are all austenitic. The steel (m) corresponds to SUS316L specified in JIS G4303.

TABLE 5

| | Chemical Composition (Weight %) | | | | | | | | | | | | Balance: Fe and Incidental Impurities | | |
|---|---|---|---|---|---|---|---|---|---|---|---|---|---|---|---|
| Steel | C | Si | Mn | P | S | Cu | Ni | Cr | Mo | Al | N | O | Al + Si | Nb + Ti + Zr | B + La + Ce |
| Examples of the Invention | | | | | | | | | | | | | | | |
| a | 0.011 | 0.15 | 0.03 | 0.018 | 0.001 | 0.02 | 27.6 | 20.3 | — | 4.2 | 0.002 | 0.003 | 4.35 | 0.02 | — |
| b | 0.006 | 0.12 | 0.02 | 0.021 | 0.002 | 0.03 | 28.1 | 18.5 | 0.42 | 5.1 | 0.012 | 0.009 | 5.22 | 0.01 | — |
| c | 0.008 | 0.11 | 0.01 | 0.011 | 0.004 | 0.01 | 27.8 | 20.9 | 0.56 | 4.1 | 0.003 | 0.002 | 4.21 | 0.03 | — |
| d | 0.008 | 0.08 | 0.02 | 0.008 | 0.002 | 0.01 | 24.3 | 16.1 | 0.53 | 3.6 | 0.004 | 0.004 | 3.68 | 0.02 | — |
| e | 0.004 | 0.03 | 0.01 | 0.018 | 0.003 | 0.01 | 29.3 | 18.3 | 1.8 | 3.6 | 0.017 | 0.005 | 3.63 | 0.01 | — |
| f | 0.006 | 0.06 | 0.01 | 0.011 | 0.002 | 0.03 | 31.2 | 20.1 | 1.2 | 3.4 | 0.002 | 0.007 | 3.46 | 0.02 | — |
| g | 0.005 | 0.05 | 0.02 | 0.008 | 0.002 | 0.03 | 15.6 | 18.7 | 0.36 | 1.57 | 0.005 | 0.008 | 1.62 | 0.01 | — |
| h | 0.005 | 2.47 | 0.01 | 0.010 | 0.001 | 0.02 | 21.6 | 19.3 | 0.24 | 0.10 | 0.003 | 0.006 | 2.57 | 0.01 | — |
| i | 0.008 | 0.42 | 0.02 | 0.010 | 0.002 | 0.01 | 27.6 | 18.4 | — | 5.5 | 0.004 | 0.003 | 5.92 | 0.01 | 0.008*2 |
| j | 0.011 | 3.52 | 0.01 | 0.007 | 0.003 | 0.01 | 23.2 | 20.4 | — | 0.4 | 0.006 | 0.002 | 3.92 | 0.01 | 0.005*3 |
| Examples of the Comparison | | | | | | | | | | | | | | | |
| k | 0.006 | 0.08 | 0.28* | 0.013 | 0.002 | 0.04 | 28.5 | 20.6 | 0.43 | 3.9 | 0.006 | 0.008 | 3.98 | 0.02 | — |
| l | 0.010 | 0.07 | 0.04 | 0.011 | 0.002 | 0.02 | 27.9 | 17.8 | 0.55 | 0.86 | 0.016 | 0.007 | 0.93* | 0.03 | — |
| m | 0.013 | 0.05 | 0.02 | 0.008 | 0.006* | 0.03 | 28.8 | 18.2 | 0.52 | 4.2 | 0.069* | 0.003 | 4.25 | 0.01 | — |
| n | 0.009 | 0.04 | 0.01 | 0.009 | 0.001 | 0.01 | 27.6 | 17.6 | 1.6 | 3.9 | 0.005 | 0.001 | 3.94 | 0.13* | — |
| o | 0.008 | 0.80 | 0.02 | 0.003 | 0.001 | 0.01 | 31.4 | 18.3 | 0.52 | 6.5 | 0.004 | 0.002 | 7.30* | 0.02 | — |

*mark show that they are outside the range specified by the invention.
*2: B 0.006%, La 0.001%, Ce 0.001%.
*3: La 0.003%, Ce 0.002%

The aforementioned steel ingots were processed to obtain steel plates in a process similar to that of Example 1. Subsequently, the thus-obtained plates were subjected to a solution treatment at a temperature of 1150° C.

Samples measuring 50 mm (width)×50 mm (length)×1 mm (thickness) were obtained from these plates through machining. The samples were then buffed over the entire surfaces thereof so as to finish their surfaces to mirror surfaces (1.6 μm in Rmax). Furthermore, the samples were oxidized through dry oxidation process or wet oxidation process to thereby form an oxide film on the surface of each plate (base metal). Table 2 shows atmospheric conditions of the dry oxidation process. Table 3 shows processing conditions of the wet oxidation process. Other conditions of oxidation are similar to those of Example 1.

The oxidized samples were examined for an oxide contained in the oxide film, the combined proportion of Al and Si to all metallic elements contained in the oxide film, the thickness of the oxide film, and corrosion resistance to ozone added water. The examination was conducted in a manner similar to that of Example 1 except for the following two conditions of the test for corrosion resistance to ozone added water: the resistivity of ultrapure water is 17 MΩcm; and samples are dipped in ultrapure water, then held in an oxygen atmosphere containing 110 mg/m$^3$ of ozone at a temperature of 40° C. for 240 hours.

Table 6 shows oxidation conditions and the results of the examination of the properties of oxide films and corrosion resistance to ozone added water. Oxidation conditions A to K as shown in Table 6 correspond to atmospheric conditions A to F of the dry oxidation process in Table 2 and processing conditions G to K of the wet oxidation process in Table 3.

TABLE 6

| | Base Metal | | Oxidation | | Oxide Film | | | Corrosion |
|---|---|---|---|---|---|---|---|---|
| Test No. | Steel | Content of (Al + Si) (Wt %) | Condition (Table 2, 3) | Temperature (°C.) | Kind of Oxide | Content of (Al + Si) (Atomic %) | Thickness of Oxide Film (nm) | Resistance to Ozone Added Water |
| Examples of the Invention | | | | | | | | |
| 1 | a | 4.35 | A | 900 | $Al_2O_3$ | 82 | 18 | ○ |
| 2 | b | 5.22 | B | 900 | $Al_2O_3$ | 89 | 19 | ○ |
| 3 | c | 4.21 | C | 900 | $Al_2O_3$ | 81 | 17 | ○ |
| 4 | d | 3.68 | A | 900 | $Al_2O_3$ | 77 | 21 | ○ |
| 5 | e | 3.63 | A | 900 | $Al_2O_3$ | 74 | 22 | ○ |
| 6 | f | 3.46 | A | 900 | $Al_2O_3$ | 76 | 26 | ○ |
| 7 | g | 1.62 | A | 900 | $Al_2O_3$ | 68 | 19 | ○ |
| 8 | h | 3.07 | A | 900 | $SiO_2$ | 72 | 15 | ○ |
| 9 | i | 5.92 | A | 900 | $Al_2O_3$ | 93 | 21 | ○ |
| 10 | j | 3.92 | A | 900 | $SiO_2$ | 78 | 16 | ○ |
| 11 | a | 4.35 | A | 650 | $Al_2O_3$ | 65 | 10 | ○ |
| 12 | a | 4.35 | A | 980 | $Al_2O_3$ | 79 | 22 | ○ |
| 13 | a | 4.35 | A | 1080 | $Al_2O_3$ | 73 | 26 | ○ |
| 14 | a | 4.35 | G | 70 | $Al_2O_3$ | 73 | 17 | ○ |
| 15 | a | 4.35 | H | 70 | $Al_2O_3$ | 85 | 16 | ○ |
| 16 | a | 4.35 | I | 70 | $Al_2O_3$ | 76 | 16 | ○ |
| Examples of the Comparison | | | | | | | | |
| 17 | k | 3.98 | A | 900 | $Al_2O_3$ | 43 | 26 | Δ |
| 18 | l | 0.93* | A | 900 | $Al_2O_3$, $SiO_2$ | 28 | 13 | x |
| 19 | m | 4.25 | A | 900 | $Al_2O_3$ | 35 | 19 | x |
| 20 | n | 3.94 | A | 900 | $Al_2O_3$ | 38 | 18 | x |
| 21 | o | 7.3* | — | — | — | — | — | — |
| 22 | a | 4.35 | A | 590* | $Al_2O_3$ | 52 | 3 | Δ |
| 23 | a | 4.35 | A | 1220* | $Al_2O_3$ | 42 | 33 | x |
| 24 | a | 4.35 | D* | 900 | $Al_2O_3$ | 30 | 35 | Δ |
| 25 | a | 4.35 | E* | 900 | $Al_2O_3$ | 62 | 4 | Δ |
| 26 | a | 4.35 | J* | 70 | $Al_2O_3$ | 21 | 4 | x |
| 27 | a | 4.35 | K* | 70 | $Al_2O_3$ | 16 | 14 | x |

*mark show that they are outside the range specified by the invention.

The results of test Nos. 1 to 7 and 9 of the invention example exhibit an Al content of not less than 1% in the steels, and the results of test Nos. 8 and 10 of the invention example exhibit a Si content of not less than 1% in the steel, indicating that the combined content of Si and Al falls within the range from 1% to 6% specified by the present invention. Furthermore, the oxidation conditions for the oxide films satisfied the conditions specified by the manufacturing method of the present invention. As in the results, each of the oxide films comprised $Al_2O_3$ or $SiO_2$ or both, and the combined proportion of them to all metallic elements contained in the oxide film was as high as 68 to 93 atomic %. Also, the test results of the invention example exhibited excellent corrosion resistance to ozone added water. The oxide film thickness (over an area where the combined proportion of Si and Al to all metallic elements contained in the oxide film was not less than 60 atomic %) fell within the range from 15 to 26 nm.

In test Nos. 11 to 13, an oxide film was formed through the dry oxidation process while the temperature of oxidation was varied over the range from 650° C. to 1080° C.; in test Nos. 14 and 15, an oxide film was formed through dipping in a nitric acid solution; and in test No. 16, an oxide film was formed through anodic electrolysis. All of these tests exhibit good results regarding the properties of oxide films and corrosion resistance to ozone added water, since the conditions of oxidation satisfied the condition specified by the present invention.

In contrast with the invention example described above, the results of test Nos. 17 to 27 except No. 21 of the comparative example exhibited poor corrosion resistance to ozone added water. This was for the following reasons. In test Nos. 17 to 21, the content of a certain constituent element of the base metal fell outside a relevant content range specified by the present invention. In test Nos. 22 to 27, the conditions of forming an oxide film failed to meet the requirements of the present invention. In test No. 21, the combined content of Si and Al of the base metal was too high. In this case, the base metal cracked during hot working due to its poor hot workability, and thus the test failed and was not completed.

The stainless steel of the present invention or the stainless steel obtained by the manufacturing method of the present invention has excellent corrosion resistance to ozone added water and emits fewer particles therefrom. Furthermore, the cost of manufacture is relatively low. Accordingly, the stainless steel of the present invention is advantageously used as a material for pipes and apparatus members in contact with ozone added ultrapure water as in the semiconductor manufacturing field, the pharmaceuticals manufacturing field, etc.

What is claimed is:

1. Stainless steel for ozone added water comprising a base metal having the following chemical composition based on % by weight and an oxide film formed on the surface of the base metal, the oxide film mainly comprising Al oxide or Al oxide and Si oxide;

| | |
|---|---|
| Cr: 12 to 30%, | Ni: 0 to 35%, |
| Al + Si: 1 to 6%, | Mo: 0 to 3%, |
| B + La + Ce: 0 to 0.1%, | Cu: max 0.1%, |
| Nb + Ti + Zr: max 0.1%, | C: max 0.03%, |
| Mn: max 0.2%, | P: max 0.03%, |
| S: max 0.01%, | N: max 0.05%, |
| O: max 0.01% and | |
| balance: Fe and incidental impurities. | |

2. The stainless steel for ozone added water according to claim 1, wherein the Ni content of the base metal is based on % by weight, as follows:

Ni: 0 to 5%.

3. Stainless steel for ozone added water comprising a base metal having the following chemical composition based on % by weight and an oxide film formed on the surface of the base metal, the oxide film mainly comprising Al oxide:

| | |
|---|---|
| Cr: 12 to 25%, | Ni: 14 to 35%, |
| Al + Si: 1 to 6%, | Mo: 0 to 3%, |
| B + La + Ce: 0 to 0.1%, | Cu: max 0.1%, |
| Nb + Ti + Zr: max 0.1%, | C: max 0.03%, |
| Mn: max 0.2%, | P: max 0.03%, |
| S: max 0.01%, | N: max 0.05%, |
| O: max 0.01% | Si: max 0.2% and |
| balance: Fe and incidental impurities. | |

4. The stainless steel for ozone added water according to claim 1, wherein the maximum roughness of the surface represented by Rmax is less than 3 $\mu$m.

5. The stainless steel for ozone added water according to claim 1, wherein the thickness of the oxide film is 5 to 500 nm.

6. The stainless steel for ozone added water according to claim 1, wherein the oxide film mainly comprises $\alpha Al_2O_3$.

7. The stainless steel for ozone added water according to claim 1, wherein the Ni content of the base metal is 0 to 5% by weight, the maximum roughness of the surface represented by Rmax is less than 3 $\mu$m and the thickness of the oxide film is 5 to 500 nm.

8. Stainless steel for ozone added water comprising a base metal having the following chemical composition based on % by weight and an oxide film formed on the surface of the base metal, the oxide film mainly comprising Al oxide:

| | |
|---|---|
| Cr: 12 to 35%. | Ni: 14 to 35%. |
| Al + Si: 1 to 6%. | Mo: 0 to 3%. |
| B + La + Ce: 0 to 0.01%. | Cu: max 0.1%. |
| Nb + Ti + Zr: max 0.1%. | C: max 0.03%. |
| Mn: max 0.2%. | P: max 0.03%. |
| S: max 0.01%. | N: max 0.05%. |
| O: max 0.01% | Si: max 0.2% and |
| balance: Fe and incidental impurities. | |

and the maximum roughness of the surface represented by Rmax is less than 3 $\mu$m and the thickness of the oxide film is 5 to 500 nm.

9. A method of manufacturing a stainless steel for ozone added water, wherein a base metal having the following chemical composition based on % by weight, is heated to a temperature of 600 to 1200° C. in a weak oxidizing atmosphere at a combined partial pressure of oxygen gas and water vapor of $10^{-11}$ to $10^{-5}$ MPa, whereby an oxide film mainly comprising Al oxide or Al oxide and Si oxide is formed on the surface of the base metal:

| | |
|---|---|
| Cr: 12 to 30%, | Ni: 0 to 35%, |
| Al + Si: 1 to 6%, | Mo: 0 to 3%, |
| B + La + Ce: 0 to 0.1%, | Cu: max 0.1%, |
| Nb + Ti + Zr: max 0.1%, | C: max 0.03%, |
| Mn: max 0.2%, | P: max 0.03%, |
| S: max 0.01%, | N: max 0.05%, |
| O: max 0.01% and | |
| balance: Fe and incidental impurities. | |

10. A method of manufacturing a stainless steel for ozone added water, wherein a base metal having the following chemical composition, based on % by weight, is dipped in a solution of nitric acid, ranging in concentration from 5 to 50% by weight, whereby an oxide film mainly comprising Al oxide or Al oxide and Si oxide is formed on the surface of the base metal:

| | |
|---|---|
| Cr: 12 to 30%, | Ni: 0 to 35%, |
| Al + Si: 1 to 6%, | Mo: 0 to 3%, |
| B + La + Ce: 0 to 0.1%, | Cu: max 0.1%, |
| Nb + Ti + Zr: max 0.1%, | C: max 0.03%, |
| Mn: max 0.2%, | P: max 0.03%, |
| S: max 0.01%, | N: max 0.05%, |
| O: max 0.01% and | |
| balance: Fe and incidental impurities. | |

11. A method of manufacturing a stainless steel for ozone added water, wherein a base metal having the following chemical composition, based on % by weight, is subjected to anodic electrolysis in a solution having a pH value of not greater than 1, whereby an oxide film mainly comprising Al oxide or Al oxide and Si oxide is formed on the surface of the base metal:

| | |
|---|---|
| Cr: 12 to 30%, | Ni: 0 to 35%, |
| Al + Si: 1 to 6%, | Mo: 0 to 3%, |
| B + La + Ce: 0 to 0.1%, | Cu: max 0.1%, |
| Nb + Ti + Zr: max 0.1%, | C: max 0.03%, |
| Mn: max 0.2%, | P: max 0.03%, |
| S: max 0.01%, | N: max 0.05%, |
| O: max 0.01% and | |
| balance: Fe and incidental impurities. | |

12. The stainless steel for ozone added water according to claim 1, in the form of a tube or pipe containing ozone added water.

13. The stainless steel for ozone added water according to claim 1, wherein Si and Al comprise at least 60 atomic % of all metallic elements in the oxide film.

14. The stainless steel for ozone added water according to claim 1, wherein Si and Al comprise at least 80 atomic % of all metallic elements in the oxide film.

15. The stainless steel for ozone added water according to claim 3, wherein the oxide film has a thickness of 5 to 500 mn.

16. The stainless steel for ozone added water according to claim 1, wherein the steel is a ferritic stainless steel, a duplex stainless steel or an austenitic stainless steel.

17. The stainless steel for ozone added water according to claim 1, wherein Nb+Ti+Zr: max 0.05%.

18. The stainless steel for ozone added water according to claim 1, wherein the steel is Mo-free.

19. The stainless steel for ozone added water according to claim 1, wherein the steel is Zr-free.

* * * * *